United States Patent [19]

Sternlieb

[11] Patent Number: 4,811,573

[45] Date of Patent: Mar. 14, 1989

[54] TWO FACE STITCH BONDED FABRIC

[75] Inventor: Herschel Sternlieb, Brunswick, Me.

[73] Assignee: W.S. Libbey Co., Lewiston, Me.

[21] Appl. No.: 127,588

[22] Filed: Dec. 2, 1987

Related U.S. Application Data

[63] Continuation of Ser. No. 882,094, Jul. 3, 1986, abandoned.

[51] Int. Cl.[4] ..... D04B 23/10

[52] U.S. Cl. ..... 66/193

[58] Field of Search ..... 66/85 A, 192, 193; 112/416, 438

[56] References Cited

U.S. PATENT DOCUMENTS

| | | | |
|---|---|---|---|
| 3,616,658 | 11/1971 | Jindra et al. | 676/85 A X |
| 4,181,514 | 1/1980 | Lefkowitz et al. | 66/193 X |
| 4,277,527 | 7/1981 | Duhl | 66/192 X |
| 4,285,216 | 8/1981 | Duhl | 66/193 X |

FOREIGN PATENT DOCUMENTS

| | | | |
|---|---|---|---|
| 2527892 | 1/1977 | Fed. Rep. of Germany | 66/192 |
| 2707001 | 9/1977 | Fed. Rep. of Germany | 66/193 |
| 231381 | 12/1985 | German Democratic Rep. | 66/192 |
| 1421747 | 1/1976 | United Kingdom | 66/192 |

*Primary Examiner*—Wm. Carter Reynolds

*Attorney, Agent, or Firm*—Cobrin, Feingertz and Godsberg

[57] ABSTRACT

A decorative fabric has two faces and is made on two stitch through type machines of different gauge. The fabric has a non-woven, flexible substrate and a first plurality of spaced yarns laid on the front face of the substrate in the filling direction. First knitting threads of predetermined gauge form a series of warpwise loop chains which bind the first filling yarns and the substrate into an integral structure. The rear face of the substrate has a second plurality fo spaced yarns laid thereon in the filling direction, and second knitting threads of predetermined gauge which are different from the predetermined gauge of said first knitting threads, thereby forming a series of warpwise loop chains which bind the second plurality of spaced yarns and said substrate into an integral structure.

4 Claims, 1 Drawing Sheet

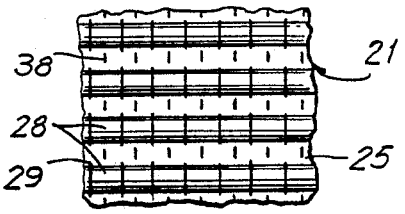
FIG. 1
FIG. 2
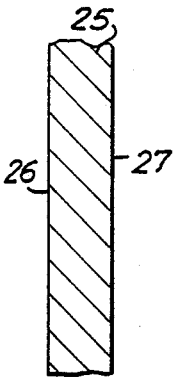
FIG. 3
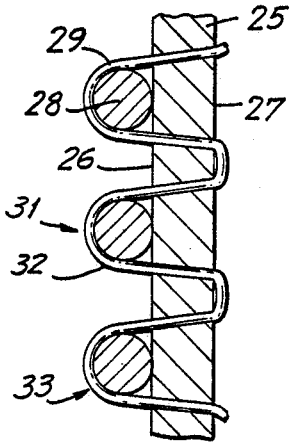
FIG. 4
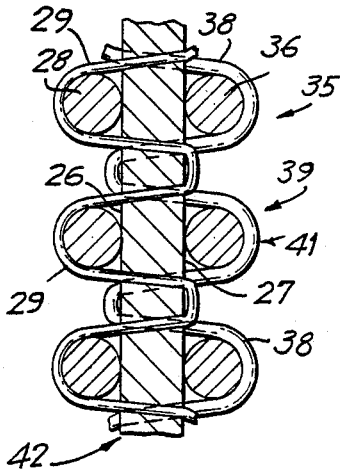
FIG. 5
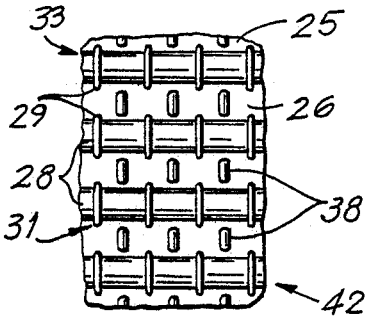
FIG. 6
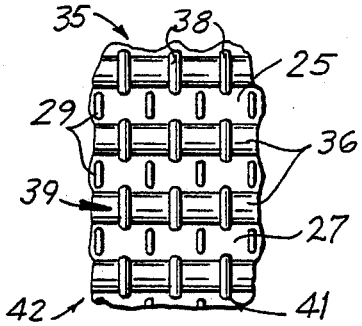

TWO FACE STITCH BONDED FABRIC

This application is a continuation, of application Ser. No. 06/882,094, filed July 3, 1986 now abandoned.

BACKGROUND OF THE INVENTION

This invention relates to an improved decorative fabric which is produced on stitch through type machines, and which is useful among other things, in decorative applications because of the decorative form on each side of the fabric.

This fabric may comprise a layer of substantially parallel warp elements, as well as a layer of substantially parallel filling elements. An open mesh fabric may be obtained by spacing the warp elements, and/or the warp elements are affixed to the flexible substrate by laying them on top of the substrate and joining both into an integral structure by means of knitting threads.

U.S. Pat. No. 3,672,187, June 27, 1972 for Fabric describes a fabric made on a stitch through type machine, and the knitting thread forms a series of warpwise loop chains which bind together into a structure and substrate, and the design elements pierce the substrate and pierce the individual design elements of a substantial number of random points to secure the substrate and design elements against relative displacement.

U.S. Pat. No. 4,192,160 to Duhl, et al, Mar. 11, 1980 for "Fabric and Apparatus and Method for Making Same" describes a fabric having warp and weft threads which are bound or stitched together, that is sew-knitted together, by a machine of the warp-knitting, multiple needle stitching type, the contrast between the various yarns and the raised textures of the warp yarns coupled with a twisting of the warp yarns on the obverse side of the material, providing a decorative relief effect.

U.S. Pat. No. 4,277,527, also to Duhl, for "Wall Construction Material Comprising a Rigid Support With A Textile Material Facing Laminated Thereto" describes a wall construction material comprising a textile material of a non-woven spun fibrous batting having a filling and one or more warp elements disposed on the filling face or obverse to constitute a front surface of the textile material. The reverse side is bonded to form a wall construction material.

U.S. Pat. No. 4,285,216 to Duhl, Aug. 25, 1981 for "Single Bar, Warp Lift-Off-Resistant, Lofted Fabric Construction" describes a fabric having a warp lift-off resistant fabric comprising a flexible substrate such as textile yarn filling elements, warp elements on the obverse, and knitting thread forming warpwise stitches. The sew-knit thread uses chain stitch courses and half-tricot stitch courses to bind the substrate and warp elements against relative displacement, and stabilize the fabric. The fabric displays a relief effect with the warp elements on the obverse side of the fabric for decorative purposes.

U.S. Pat. No. 2,141,560 to Rucnick, Dec. 27, 1938 for Ornamental Fabric and Method of Making Same, shows a colored stencil sheet or pattern sheet as a backing to a translucent or transparent facing sheet. The stencil sheet may be cloth such as muslin on which a desired colored pattern is printed. An ordinary stitching operation is employed.

The various machines for performing the operation of sewknitting described above may be of the "Malimo" type, well known in the trade, and capable of effecting stitch bonding with interlocking chain stitches, or plain chain stitches, similar to the stitches used in warp knitting. The Malimo type machines are known and understood in the art. Similar effects may be achieved by using weft insertion machines such as made by Lieber or Meyer in Germany.

SUMMARY OF THE INVENTION

The Decorative Fabric of this invention can be made on a "Malimo" sewing-knitting machine which is well known in the trade for stitch bonding fabrics made of sheets of yarn, such as warp yarns and weft yarns, the yarn being connected by the stitches onto a textile fabric.

The substrate of the invention is usually a non-woven continuous limp flexible fabric formed of interlocked and intermingled fibers such as a felt, thin batting spun bonded, spun laced, or similar material, and this substrate has a front or obverse face, and a rear face.

Through a first stitch bonding machine of predetermined gauge a first plurality of spaced yarns are laid on the front face of the substrate in the filling direction and first knitting threads of a predetermined gauge form a series of warpwise loop chains that bind the first filling yarns and the substrate into an integrated structure.

Through a second bonding machine of different gauge on the rear face of the substrate in the filling yarn direction a second plurality of spaced yarns are laid thereon and second knitting threads of a predetermined gauge, but usually not an identical gauge of the first knitting threads form a series of warpwise loop chains which bind the second plurality of spaced yarns and said substrate into an integral structure.

The resultant fabric is greatly improved over ordinary fabric in that the fabric can be heavier than fabric made with a single machine of one gauge.

For instance, a 14 gauge fabric made on a single stitch bonding machine could not be made as heavy as a fabric made on a first 7 gauge machine and then made on a second 9 gauge machine.

The resultant fabric has a "phased" appearance vertically since there would be a stitching repeat pattern because the combination of a 7 gauge stitch bonding machine and a 9 gauge stitch bonding machine would repeat every 63 needles, and therefore, not only be heavier, but also extremely decorative.

There are other advantages to this fabric; since the fabric is a balanced fabric because it has yarns on both sides of the flexible backing or substrate, and therefore, it has absolutely no tendency to "twist" or "cup", which is a distinct advantage.

BRIEF DESCRIPTION OF THE DRAWINGS

FIG. 1 is a diagrammatic plan view of the fabric of the invention with a design on the substrate, visible through the mesh formed by the spaces between generally parallel weft yarns and generally parallel rows of stitching;

FIG. 2 is a side elevational view of the non-woven flexible substrate or backing;

FIG. 3 is a side elevational view of the substrate with a stitching yarn and a filling yarn on one face;

FIG. 4 is a side elevational view of the substrate with stitching yarns and filling yarns on the front and rear faces of the substrate;

FIG. 5 is a schematic front or plan view of the stitching yarns and the filling yarns; and FIG. 6 is a schematic rear view of the stitching yarns and the filling yarns.

DESCRIPTION OF A PREFERRED EMBODIMENT

As shown in the drawing the decorative fabric 21 of the invention is made on two stitch through type machines of different gauge (not shown) such as Malimo Machines, and the like.

The decorative fabric 21 has a non-woven flexible backing or substrate 25, which has a front or obverse face 26, as well as a rear face 27 (See FIGS. 2, 3, and 4).

The substrate is run through a stitch bonding machine or stitch through type machine (not shown) of a specific gauge. Depending on the number of needles and warp guides per 25 mm, fabrics of different weight classes are produced, correspondingly the machines have various gauges. Presently in existence there are machines with $3\frac{1}{2}$, 7, 10, 14, and 18 gauge and finer gauges are presently being developed.

A first plurality of spaced or filling yarns 28, are laid on the front face 26 of the substrate 25 in the filling direction.

First knitting threads or stitch yarns 29 have a gauge which has been predetermined and could be at least 3.5 gauge and may be no more than 18 gauge, but would be preferably 7 gauge. The said first knitting threads form a series 31 of warpwise loop chains 32. The chains 32 bind the first filling yarns 28 and the substrate 25 into an integral structure 33.

The fabric 21 is then run through a second stitch bonding machine or stitch through type machine (not shown) of another gauge, preferably not the same gauge as the first machine, and a second plurality 35 of spaced or filling yarns 36 are laid on the rear face 27 of the substrate 25, in the filling direction.

Second knitting threads or stitch yarns 38 which are of a predetermined gauge such as at least 3.5 gauge, but less than 18 gauge, but would be more or less than the first knitting threads or stitch yarns, and preferably be 9 gauge.

The second knitting threads 38 form a series 39 of warpwise loop chains 41. The chains 41 bind the second plurality 35 of spaced yarns 36, as well as the substrate 25, into an integral structure 42.

As will be appreciated, the novel product of the present invention may be used in many ways, such as vertical blinds or shades, and various modifications may be made in the invention described herein. For example, different colors may be used in the threads, or yarns, etc. to give unusual and hitherto unobtainable effects.

I claim:

1. A decorative fabric made on two stitch through type machines of different gauge, such as Malimo Machines, said fabric comprising:

a non-woven, flexible substrate having a front face and a rear face;

a first plurality of spaced yarns laid on the front face of said substrate in the filling direction;

first knitting threads of predetermined gauge forming a series of warpwise loop chains which bind only said first filling yarns and said substrate into an integral structure;

a second plurality of spaced yarns laid on the rear face of said substrate in the filling direction; and second knitting threads, of predetermined gauge different from the predetermined gauge of said first knitting threads forming a series of warpwise loop chains which bind only said second plurality of spaced yarns and said substrate into said integral structure.

2. A decorative fabric as specified in claim 1 wherein the first knitting threads forming a series of warpwise loop chains, are at least 3.5 gauge and no more than 18 gauge.

3. A decorative fabric as specified in claim 1 wherein the second knitting threads forming a series of warpwise loop chains are at least 3.5 gauge and no more than 18 gauge.

4. A decorative fabric as specified in claim 1 wherein the first knitting threads are 7 gauge and the second knitting threads are at least 9 gauge.

* * * * *